US006732466B2

(12) United States Patent
Bentley

(10) Patent No.: US 6,732,466 B2
(45) Date of Patent: May 11, 2004

(54) RECOIL SYSTEM FOR THE RECEIVER OF A FIREARM

(76) Inventor: James K. Bentley, 2405 Couper St., Cambria, CA (US) 93248

( * ) Notice: Subject to any disclaimer, the term of this patent is extended or adjusted under 35 U.S.C. 154(b) by 68 days.

(21) Appl. No.: 10/223,818

(22) Filed: Aug. 19, 2002

(65) Prior Publication Data

US 2004/0031182 A1 Feb. 19, 2004

(51) Int. Cl.[7] ..... F41C 23/04
(52) U.S. Cl. ..... 42/74
(58) Field of Search ..... 42/74, 1.06, 73; 89/198, 199

(56) References Cited

U.S. PATENT DOCUMENTS

| | | | | | |
|---|---|---|---|---|---|
| 910,276 | A | * | 1/1909 | Easedale | 42/74 |
| 1,379,989 | A | * | 5/1921 | Johnson | 42/74 |
| 2,731,753 | A | * | 1/1956 | Mathieu | 42/74 |
| 2,779,249 | A | * | 1/1957 | Saetter-Lassen | 89/198 |
| 3,381,405 | A | * | 5/1968 | Edwards | 42/74 |
| 3,405,470 | A | * | 10/1968 | Wesemann | 42/74 |
| 3,461,589 | A | * | 8/1969 | Vironda | 42/74 |
| 3,491,473 | A | * | 1/1970 | Eastin | 42/74 |
| 3,492,749 | A | * | 2/1970 | Vironda | 42/74 |
| 3,707,797 | A | * | 1/1973 | Ruth | 42/74 |
| 4,164,825 | A | * | 8/1979 | Hutchison | 42/1.06 |
| 4,279,091 | A | * | 7/1981 | Edwards | 42/1.06 |
| 4,769,937 | A | * | 9/1988 | Gregory et al. | 42/74 |
| 4,910,904 | A | * | 3/1990 | Rose | 42/74 |
| 5,031,348 | A | * | 7/1991 | Carey | 42/74 |
| 5,367,812 | A | * | 11/1994 | Lautrec | 42/74 |
| 5,410,833 | A | * | 5/1995 | Paterson | 42/73 |
| 5,617,664 | A | * | 4/1997 | Troncoso | 42/1.06 |
| 5,722,195 | A | * | 3/1998 | Bentley et al. | 42/74 |
| 5,827,992 | A | * | 10/1998 | Harris et al. | 89/191.01 |
| 5,909,002 | A | * | 6/1999 | Atchisson | 89/130 |
| 5,974,718 | A | * | 11/1999 | Bentley et al. | 42/74 |
| 6,196,108 | B1 | * | 3/2001 | Murello | 89/44.02 |
| 6,481,142 | B1 | * | 11/2002 | McCarthy | 42/74 |
| 6,481,143 | B2 | * | 11/2002 | McCarthy | 42/74 |

FOREIGN PATENT DOCUMENTS

| | | | |
|---|---|---|---|
| DK | 160650 | * | 9/1957 |
| NL | 290784 | * | 6/1965 |

* cited by examiner

*Primary Examiner*—Michael J. Carone
*Assistant Examiner*—Troy Chambers
(74) *Attorney, Agent, or Firm*—Charles C. Logan, II

(57) ABSTRACT

A recoil system for the receiver of the firearm having an extension spring recoil assembly that is incorporated into a butt stock assembly. The butt stock assembly has an elongated receiver member and an elongated gunstock sleeve member. The front end of the extension spring recoil assembly is rigidly connected within the rear end of the receiver attachment member. The gunstock sleeve member has a front bore hole extending rearwardly most of its length and the rear end of the extension spring recoil assembly resides therein. The extension spring recoil assembly has an outer tubular member and inner tubular member that is telescopically received therein. An elongated extension coil spring is positioned within the inner tubular member and has its forward end rigidly secured therein. The rear end of the extension coil spring is rigidly attached to the rear end of the outer tubular member. When the firearm is fired, recoil passes from the receiver rearwardly through the receiver attachment member causing the outer tubular member to travel rearwardly and stretch the extension spring thereby absorbing most of the recoil. As the recoil dissipates, the extension spring contracts causing the outer tubular member and receiver attachment member to travel forwardly. The extension spring recoil assembly can also be used in conjunction with a pistol grip recoil assembly that itself is connected to the rear end of the receiver. One of the embodiments allows the butt stock assembly to be rotated into a horizontal position.

16 Claims, 4 Drawing Sheets

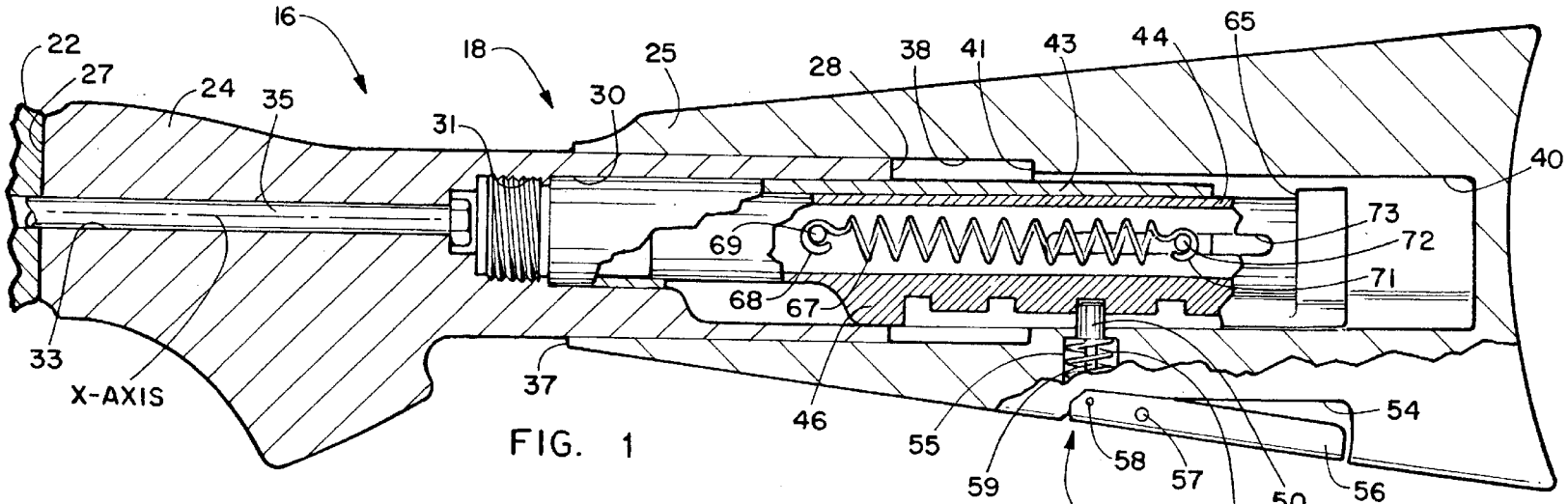
FIG. 1
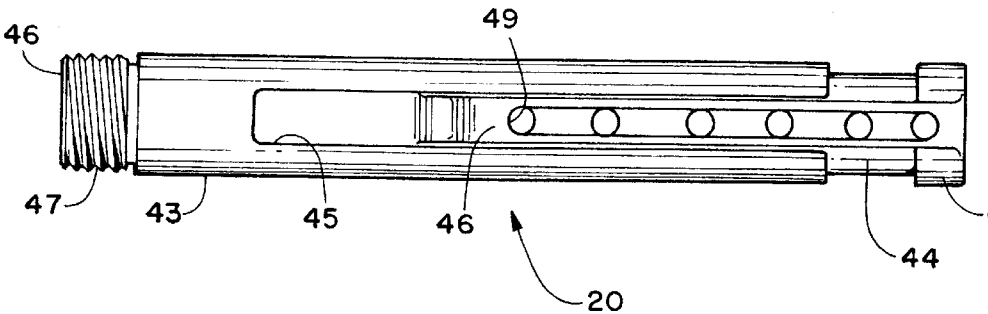
FIG. 4
FIG. 2
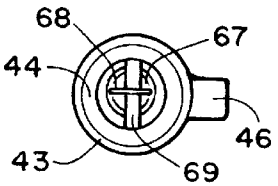
FIG. 3

RECOIL SYSTEM FOR THE RECEIVER OF A FIREARM

BACKGROUND OF THE INVENTION

The invention relates to firearms and more specifically to a recoil system for the receiver of a firearm.

One of the age old problems that has existed with firearms is the fact that many of them have a severe recoil that affects the person firing the weapon. In firearms such as shotguns and rifles, the rear end of the butt stock is positioned against the shooter's shoulder and the recoil often causes the shooter to raise the front of the firearm each time the weapon is fired. Also the amount of recoil varies depending upon the amount of explosive being fired and the recoil can result in pain and/or bruising to the shoulder area of the person firing the weapon. One example of the recoil being detrimental to a shooter's accuracy is when the firearm is a shotgun being used for skeet shooting by a man or a woman.

In the past, the best prior art recoil systems for the butt stock of a firearm have been very expensive and the inexpensive systems did not function properly. Two examples of expensive systems are a hydro-coil fluid dampening system and a pneumatic air chamber system. The present day inexpensive recoil systems utilize compression coil springs to absorb the recoil forces. If the compression coil spring is a little too strong, you get more recoil than with a regular firearm. If the compression coil spring is not strong enough it is worse, in that it gives the gun some travel and it is the same as holding the butt stock to loosely.

One of the improvements in recoil systems for a firearm is illustrated in the Bentley et al U.S. Pat. No. 5,722,195. It has a pistol grip recoil assembly having a recoil base member and a pistol grip. The recoil base member is detachably secured to the rear end of the receiver of the firearm and it has an inverted T-shaped rail formed on its bottom wall. This inverted T-shaped rail is captured within and slides in an inverted T-shaped groove in the top end of the pistol grip. A recess formed in the front wall of the pistol grip adjacent its top end allows the trigger guard of the firearm to travel rearwardly with respect to the pistol grip when the firearm is fired. Various embodiments utilize springs to return the recoil base member forwardly to its static position after dissipating the recoil of the firearm resulting from its being fired.

Another recent improved recoil system for a firearm is illustrated in the Bentley et al U.S. Pat. No. 5,752 339. This patent discloses a recoil system for the butt stock of a firearm having a recoil suppressor assembly whose front end is mounted in the cavity in the rear end of the gun stock. The piston ram of the recoil suppressor assembly in its static position extends rearwardly into a bore hole cavity of an elongated recoil housing. When the firearm is shot, the elongated body portion of the recoil suppressor assembly and its transversely extending mounting flange portion instantaneously travel rearwardly into the bore cavity with the bore hole of the body housing reciprocally traveling over the piston ram. A coil spring whose front end is secured to the front end of the body portion and whose rear end is secured to a cam assembly returns the elongated body portion to a static position once the recoil of the firearm has been suppressed.

It is an object of the invention to provide a novel recoil system for a firearm that minimizes the amount of recoil force experienced by the person firing the weapon.

It is also an object of the invention to provide a novel recoil system for the butt stock of a firearm that minimizes pain to the shoulder to the person firing the weapon due to recoil forces.

It is another object of the invention to provide a novel recoil system for a firearm that requires limited modification to the butt stock.

It is a further object of the invention to provide a novel recoil system for a firearm that utilizes an extension coil spring.

It is also an object of the invention to provide a novel recoil system for the butt stock of a firearm that is easily mounted to the rear end of a conventional butt stock.

It is a further object of the invention to provide a novel recoil system for shotguns and rifles that is economical to manufacture and market.

It is an additional object of the invention to provide a novel double recoil system for the receiver of a firearm.

It is also an object of the invention to provide a novel butt stock for a firearm with an adjustable length of pull to accommodate shooters of different stature.

It is another object of the invention to provide a novel butt stock for a firearm that can be rotated from its normal novel butt stock for a firearm that can be rotated from its normal vertical position to a horizontal position to facilitate use of the firearm in close quarters where the butt of the firearm would not be positioned against the shooter's shoulder.

SUMMARY OF THE INVENTION

The novel recoil system has been designed to be incorporated into a butt stock assembly of a firearm such as a rifle. The main component of the recoil system is an extension spring recoil assembly having an outer tubular member and an inner tubular member. The front end of the outer tubular member is rigidly secured within the front end portion of the butt stock assembly that is secured to the rear end of the receiver of the firearm. The inner tubular member is telescopically received within the rear end of the outer tubular member. An extension spring is axially aligned within the interior of the inner tubular member and has its front hook portion secured by a transversely extending pin that has its opposite ends rigidly connected to the inner surface of the inner tubular member. The rear end of the extension spring has its hook portion secured to a transversely extending pin whose opposite ends pass through aligned longitudinally extending slots on the opposite side walls of the inner tubular member. The ends of the rear pin are rigidly secured to the inner wall surface of the outer tubular member.

In the different butt stock embodiments using the extension spring recoil assembly, the rearward travel of the inner tubular member in the gun stock is restricted. The recoil produced by firing the gun sends the structure attached to the rear end of the receiver rearwardly. Since the front end of the outer tubular member is rigidly attached to that structure, they both travel rearwardly causing the extension spring to be stretched rearwardly and dissipate the recoil of the gun. After the recoil force has been dissipated, the extension spring returns to its original static position while pulling the outer tubular member forwardly to its static position.

The novel extension spring recoil assembly has also been adapted to be used in conjunction with the pistol grip recoil system of the Bentley et al U.S. Pat. No. 5,722,195 (the structure of this patent is incorporated by reference). This is accomplished by forming a connector housing on the upper rear end of the pistol grip for receiving the front end of the novel extension spring recoil assembly. An adjustable length butt stock assembly has a bore hole formed in its front end for receiving the rear end of the extension spring recoil assembly. The pistol grip recoil assembly dissipates the major portion of the recoil from the firearm and the remaining recoil is dissipated by the extension spring recoil assembly secured to its connector housing. The novel structure for connecting the front end of the extension spring recoil system to the connector housing allows the butt stock assembly to be rotated to a horizontal position to facilitate use of the firearm in close quarters where it is not positioned against the shooter's shoulder. The connection structure in the connector housing could be utilized to connect the extension spring recoil assembly directly to the rear end of the receiver or to an adaptor connected to the rear end of the receiver.

DESCRIPTION OF THE DRAWINGS

FIG. 1 is a side elevation view of the extension spring recoil system incorporated in a butt stock assembly with portions broken away or in cross section;

FIG. 2 is a bottom plan view of the extension spring recoil assembly;

FIG. 3 is a front elevation view of FIG. 2;

FIG. 4 is a rear elevation view of FIG. 2;

DESCRIPTION OF THE PREFERRED EMBODIMENT

Figure 5:
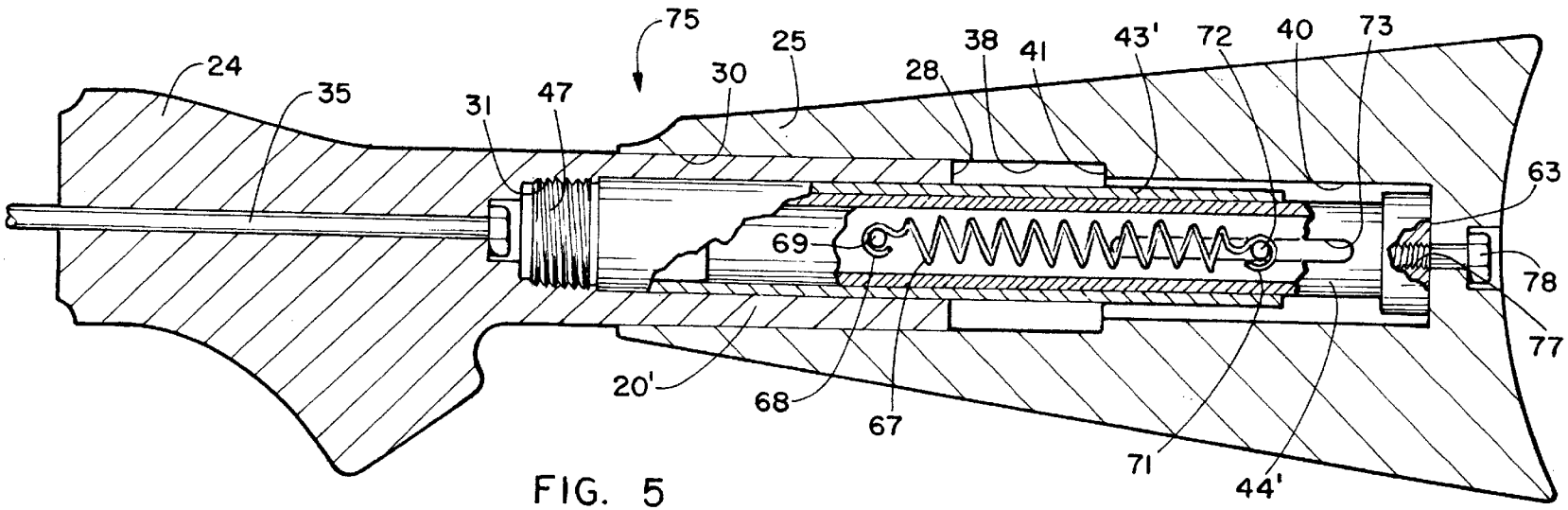
FIG. 5 is a vertical cross section view illustrating a first alternative embodiment of the extension spring recoil assembly.

The novel extension spring recoil system for the receiver of a shotgun or rifle will now be described by referring to FIGS. 1–4 of the drawings. The recoil system is generally designated numeral 16 and it has a butt stock assembly 18 having an extension spring recoil assembly 20 mounted therein. The butt stock assembly 18 is detachably secured to the rear end of a receiver 22 of a rifle or shotgun.

Butt stock assembly 18 has a receiver attachment member 24 and a gunstock sleeve member 25. Receiver attachment member 24 has a longitudinally extending X-axis, a front end 27 and a rear end 28. A rear bore hole 30 extends forwardly from rear end 28 for receiving the front end of extension spring recoil assembly 20. The front end of rear bore hole 30 has internal threads 31. A smaller front bore hole 33 extends rearwardly from front end 27 until it reaches the front end of bore hole 30. A bolt 35 extends through front bore hole 33 and its externally threaded front end is screwed into the rear end of receiver 22. This securely connects receiver attachment member 24 to receiver 22 of the firearm.

Gunstock sleeve member 25 has a front end 37 having a front bore hole 38 extending rearwardly therefrom for telescopically receiving the rear end of receiver attachment member 24. A rear bore hole 40 extends rearwardly from the rear end of front bore hole 38 and it has a smaller diameter thereby forming a shoulder 41 that limits the distance that the rear end of receiver attachment member 24 can travel within gunstock sleeve member 25. Gunstock sleeve member 25 is adjustable axially with respect to receiver attachment member 24 so that it can be fitted to different size users of the firearm. A detailed description of how it is adjusted will be included later. The rear end of gunstock sleeve member would normally have a butt pad attached thereto.

Extension spring recoil assembly 20 has a longitudinally extending X-axis that aligns with the X-axis of receiver attachment member 24. Extension spring recoil assembly 20 has an outer tubular member 43 and an inner tubular member 44. Outer tubular member 43 has a front end 46 with external threads 47 formed adjacent thereto that mate with the internal threads 31 of receiver attachment member 24 for securing the extension spring recoil assembly 20 to receiver attachment member 24. The rear end of outer tubular member 43 is open and it telescopically receives inner tubular member 44. Inner tubular member 44 has a longitudinally extending rib member 46 on its bottom surface and outer tubular member 43 has slot 47 in its bottom surface that provides for unrestricted axial travel of inner tubular member 44 when gunstock sleeve member 25 is axially adjusted with respect to the rear end of receiver attachment member 24. The length of pull can be adjusted approximately from 12 inches to 16 inches to accommodate the stature of different shooters. The bottom surface of rib member 46 has a plurality of longitudinally spaced recesses 49 for removably receiving the head member 50 of the spring loaded adjustment lever assembly 52.

The bottom surface of gunstock sleeve member 25 has a recess 54 formed in its bottom surface and a bore hole 55 extends upwardly from the end of the recess 54. Lever 56 is secured in recess 54 by pivot pin 57. Pivot pin 58 connected to the front end of lever 56 is secured to the rear end of the rod 59 having a head 50 connected to its top end. When lever 56 is pushed upwardly at its rear end, spring 61 is compressed as rod 59 and its head member 50 are pulled downwardly until it exits one of the recesses 49. At this point the gunstock sleeve member 25 can be adjusted either forwardly or rearwardly to adjust the length of butt stock assembly 18 to custom fit it to different size individuals using the firearm.

Inner tubular member 44 has an open front end and its rear end 63 has an annular flange 64 that forms a shoulder 65 that limits the rearward travel of outer tubular member 43. An extension spring 67 has a hook portion 68 at its forward end that is captured by transversely extending pin 69 whose opposite ends are secured to the inner surface of inner tubular member 44 (see FIG. 3). The rear end of extension spring 67 has a hook portion 71 that is captured by a pin 72 that has its opposite ends extending through slots 73 on both sides of inner tubular member 44. The opposite ends of pin 72 are secured to the inner surface of outer tubular member 43. When the firearm is fired, the recoil produced will send the receiver attachment member 24 rearwardly. Since the outer tubular member 43 of extension spring coil assembly 20 is rigidly connected to receiver attachment member 24, it will also travel rearwardly along with pin 72 which is rigidly secured thereto. This will cause extension spring 67 to be stretched rearwardly until the rear end of outer tubular member 43 reaches shoulder 65 on inner tubular member 44.

Extension spring 67 thereby absorbs the recoil of the firearm and the spring will also contract after the recoil force is absorbed to cause outer tubular member 43 to travel forwardly along with receiver attachment member 24.

FIG. 5 illustrates the first alternative embodiment of the butt stock assembly 75. Similar structure described in FIGS. 1–4 are given like numbers and identification. Butt stock assembly 75 does not have structure which allows it to be custom fitted to different size users. It has the receiver attachment member 24 that is secured by a bolt 35 to the rear end of receiver 22. Gunstock sleeve member 25 has front bore hole 38 with a shoulder 41 at its rear end where rear bore hole 40 starts. An external spring recoil assembly 20' is similar to that previously described but it does not have a rib member 46 along its bottom surface. Rear end 63 of inner tubular member 44' has a threaded bore hole 77 into which a bolt 78 is screwed to provide rigid attachment to the gunstock sleeve 25. Extension spring 67 has its front end rigidly secured to pin 69 by hook portion 68. The opposite ends of pin 69 are rigidly attached to the inner surface of inner tubular member 44'. The rear end of extension spring 67 has a hook portion 71 that is captured by a pin 72 that extends through longitudinally extending slots 73 in inner tubular member 44'. The opposite ends of pin 72 are rigidly secured to the inner surface of outer tubular member 43'. The recoil of the firearm when it is fired will cause receiver attachment member 24 to travel rearwardly until it hits shoulder 41. At this same time outer tubular member 43' has to travel rearwardly which cause spring 67 to be stretched and thereby absorb most of the recoil of the weapon being fired. After the recoil force dissipates spring 67 will contract causing outer tubular member 43' to travel forwardly along with the receiver attachment member 24. A butt pad would normally be attached to the rear end of gunstock sleeve 25.

Figure 6:
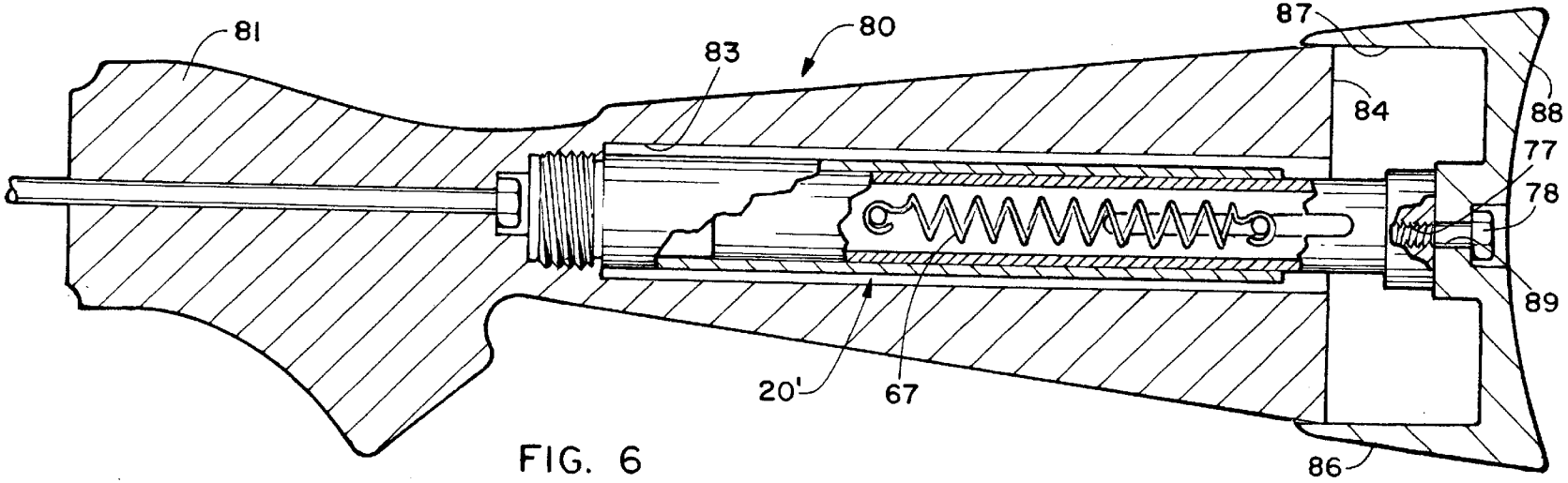
FIG. 6 is a vertical cross section view illustrating the first alternative embodiment of the extension spring recoil assembly in a second embodiment of the butt stock assembly.

In FIG. 6 the extension spring recoil assembly 20' is mounted in an alternative embodiment butt stock assembly 80. It has a receiver attachment member 81 having a bore hole 83 extending in from its rear end 84. A gunstock sleeve member 86 has a bore hole 87 in its front end that telescopically receives the rear end of receiver attachment member 81 as it travels rearwardly. Gunstock sleeve 86 has a rear wall 88 having bore hole 89 into which a bolt 78 passes to thread into internally threaded bore hole 77 in the rear end of inner tubular member 44'. The external spring recoil assembly 20' functions in the same manner as described above with respect to FIG. 5. A butt pad would normally be attached to the rear end of gunstock sleeve 25.

Another alternative embodiment using the novel recoils system is illustrated in FIGS. 7–10. A slightly modified extension spring recoil assembly 20 such as illustrated in FIGS. 1–4 is utilized in conjunction with a pistol grip assembly 95 such as described and illustrated in the Bentley et al U.S. Pat. No. 5,722,195 (the structure of this patent is incorporated by reference). Pistol grip assembly 95 has a recoil base member 97 and a pistol grip 98. An inverted T-shaped rail or guide is formed on the bottom wall of recoil base member 97. The top end of pistol grip 98 has an inverted T-shaped groove or track in which the T-shaped rail of recoil base member 97 travels axially. A cavity 99 is formed in the bottom of the inverted T-shaped rail or glide found on the bottom wall of recoil base member 97. Pistol grip 98 has a chamber 101 extending from its top end down to its bottom end. A coil spring 102 has a hook member 103 formed on its bottom end that is captured by a retainer pin 104 secured transversely to interior of pistol grip 98. The top end of spring 102 has a hook member 106 that is captured by a pin 107 passing through the lower bi-furcated arms 109 of the bellcrank-type lever 110. A pivot pin 112 extends transversely with its opposite ends rigidly secured to the inside of pistol grip 98. A pair of upper bi-furcated arms 114 have a cam roller 115 secured thereto by a pin 116. As discussed in the Bentley et al patent, recoil caused by the firing of the weapon causes recoil base member 97 to travel rearwardly which also forces cam roller 115 rearwardly as cavity 99 moves rearwardly. This travel rearwardly of cam roller 115 causes bellcrank-type lever 110 to pivot clockwise causing the spring 102 to be stretched upwardly and absorb most of the recoil of the recoil of the weapon.

Figures 7, 8, 9, 10:
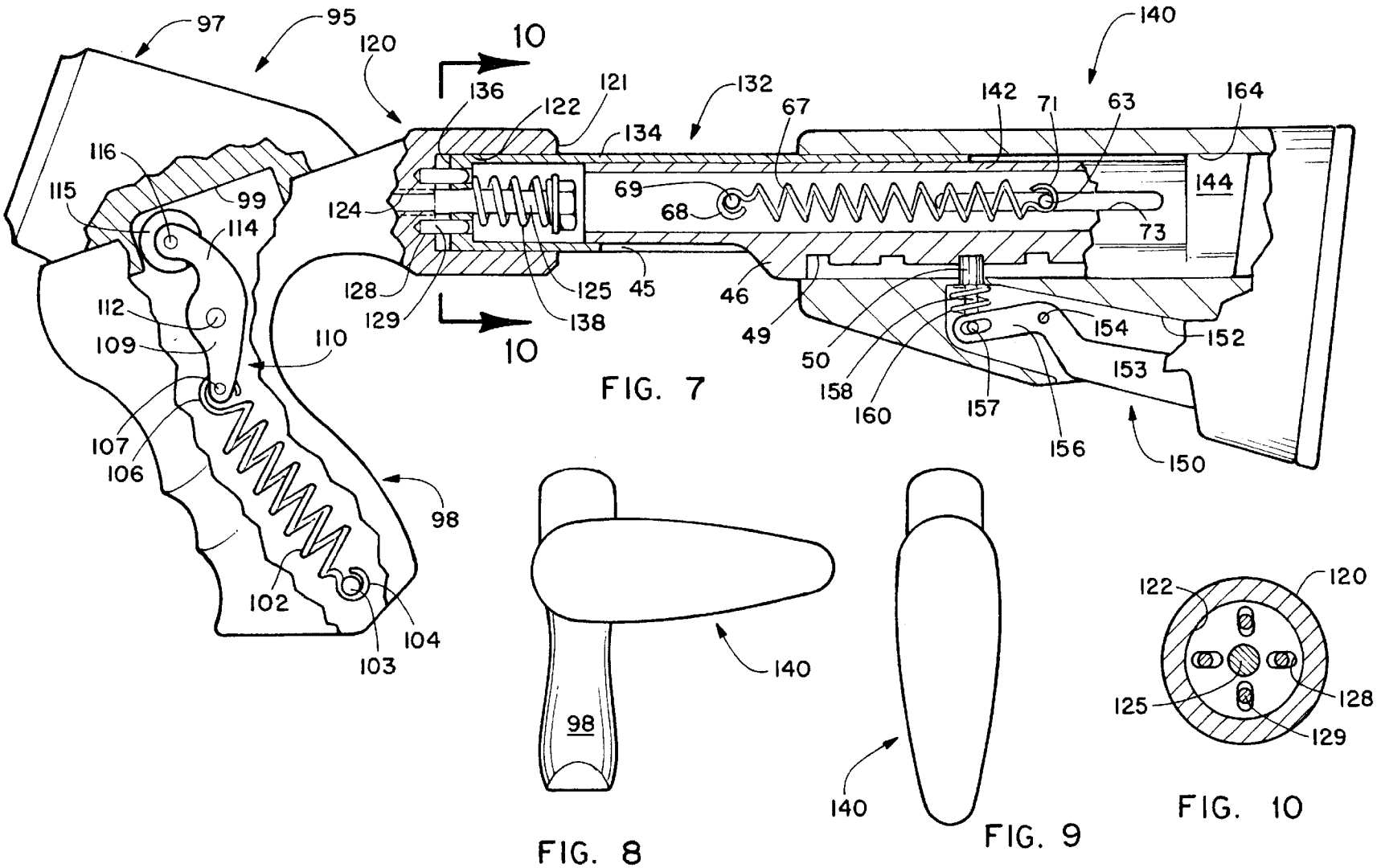
FIG. 7 is a side elevation view partially in cross section and with portions broken away illustrating a second alternative embodiment of the extension spring recoil assembly attached to the rear end of a pistol grip assembly.
FIG. 8 is a reduced size rear elevation view of FIG. 7 showing the butt stock assembly oriented horizontally with respect to the vertically oriented pistol grip recoil assembly.
FIG. 9 is a reduced size rear elevation view showing the butt stock assembly oriented vertically and the pistol grip recoil assembly oriented vertically as seen in FIG. 7.
FIG. 10 is a cross sectional view taken along lines 10—10 of FIG. 9.

The upper rear end of pistol grip 98 has a connector housing 120 formed thereon. It has a rear wall 121 having a bore hole 122 extending forwardly therefrom. The front end of bore hole 122 has a threaded bore hole 124 for receiving bolt 125. Surrounding the threaded bore hole 124 are four lug bore holes 128 for receiving lug members 129. A modified extension spring recoil assembly 132' similar to that illustrated in FIGS. 1–4 has an outer tubular member 134 having a front wall 136 having four lug members 129 extending forwardly therefrom. Front wall 136 also has a central bore hole through which the bolt 125 passes. A spring 138 is captured between the head of bolt 125 and rear wall 136. A rearward pulling force on butt stock assembly 140 will compress spring 125 and remove lug members 129 from bore holes 128. The butt stock assembly 140 can then be rotated ninety degrees so that it is horizontally oriented in the position illustrated in FIG. 8. This action can take place quickly and easily. By releasing the rearward pulling force on butt stock assembly 140, spring 138 will pull front wall 136 forward causing lug members 129 to engage their respective bore holes 128. FIG. 9 illustrates butt stock assembly in the vertical orientation seen in FIG. 7. The embodiment described in incorporates structure utilizing two extension coil springs functioning in series.

External spring recoil assembly 132 has an inner tubular sleeve 142 having a flange 144 extending from its rear end. Outer tubular member 134 has a rib member 46 extending longitudinally along its bottom surface and has a plurality of recesses 49 for receiving head member 50. A spring loaded adjustment lever assembly 150 is similar to that illustrated in FIGS. 1–4. Butt stock assembly 140 has a recess 152 formed in its bottom surface for receiving spring loaded adjustment lever assembly 150. A lever 153 is pivotal about a pin 154 that causes the arm portion 156 to travel downwardly. A pin 157 secured to the bottom end of rod 158 is pulled downwardly causing head member 50 to drop downwardly out of recess 49 so that the length of the butt stock assembly can be adjusted for different size shooters. Once the pressure on lever 153 is released spring 160 will press the head member 50 into its appropriate recess 49. Butt stock assembly 140 has a bore hole 164 formed in its front wall for receiving the rear end of extension spring recoil assembly 132. A hook portion 68 of extension spring 67 is captured by a pin 69 whose opposite ends are rigidly secured to the inner surface of inner tubular member 142. Hook portion 71 is captured by pin 63 whose opposite ends pass through slots 73 on opposite sides of inner tubular member 142. The opposite ends of pin 63 are rigidly secured to the inner surface of outer tubular member 134. When the firearm is fired, the pistol grip recoil assembly will absorb most of the recoil with the remainder being dampened by rearward travel of outer tubular member 134 rearwardly within bore hole 164. Inner tubular member 142 is restricted from axial travel and spring 67 will be stretched rearwardly by travel of outer tubular member 134 rearwardly and absorb the remaining recoil of the firearm. When the recoil has been dissipated, extension spring 67 will be retracted and outer tubular member 134 will travel forwardly.

The connector housing structure could be incorporated into the rear end of a receiver or an adapter therefore to allow the extension spring recoil assembly 132 and butt stock assembly 140 to be used with any shotgun or rifle thereby giving it the capability of rotating the butt stock assembly to a horizontal position as illustrated in FIG. 8.

Figure 11:
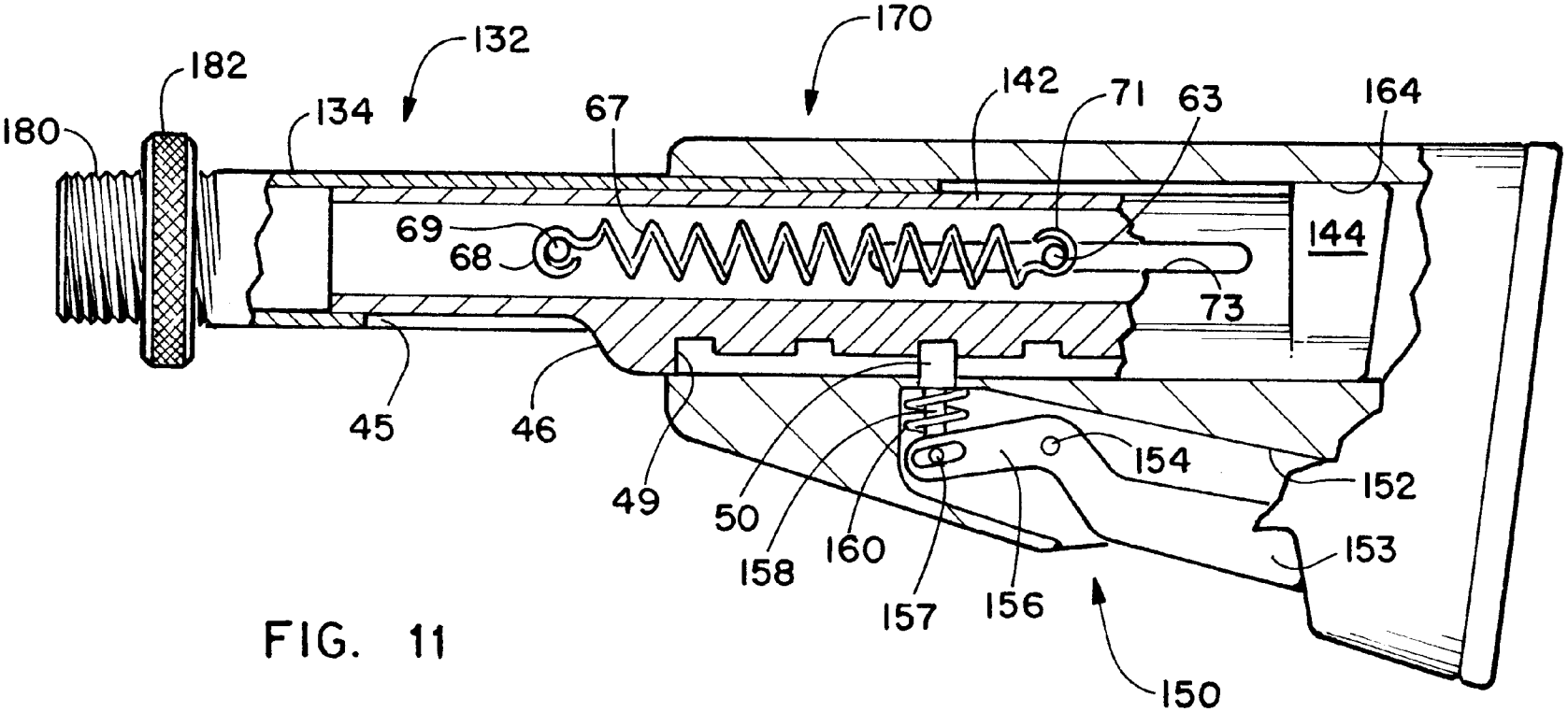
FIG. 11 is a side elevation view of the butt stock assembly of FIG. 7 showing a different type of front end structure for attachment to the rear of a pistol grip recoil assembly.

An alternative butt stock assembly 170 is illustrated in FIG. 11. The front end of outer tubular member 134 has external threads 180 that would mate with a modified connector housing 120 that would have an internally threaded bore hole in its rear wall. A flange 182 having a knurled outer surface aids in screwing the front end of extension spring coil assembly 132 into the rear end of a connector housing 120. This embodiment would function in the same manner as that previously discussed in FIG. 7.

What is claimed is:

1. A recoil system for the receiver of a firearm comprising;

an extension spring recoil assembly having a front end, a rear end, an elongated outer tubular member having an open rear end, and an elongated inner tubular member telescopically received in said open rear end of said outer tubular member; extension spring means connecting said inner tubular member to said outer tubular member for absorbing recoil produced when a firearm is fired;

a butt stock assembly having an elongated receiver attachment member and an elongated gunstock sleeve member; said elongated receiver attachment member having a rear end and said elongated gunstock sleeve member having a front end; means in said front end of said elongated gunstock sleeve member for telescopically receiving said rear end of said elongated gunstock sleeve member;

said receiver attachment member having a longitudinally extending X-axis, a front end, and a rear end bore hole extending forwardly from said rear end of said receiver attachment member for receiving said front end of said extension spring recoil assembly;

means for fixedly securing said outer tubular member in said rear bore hole of said receiver attachment member; and said gunstock sleeve member having a longitudinally extending X-axis, a rear end and a front bore hole extends into said front end for reciprocally receiving the recoil of said rear end of said receiver attachment member when a firearm is fired.

2. A recoil system for the receiver of a firearm as recited in claim 1 further comprising attachment means for securing said front end of said receiver attachment member to the rear end of a receiver of a firearm.

3. A recoil system for the receiver of a firearm as recited in claim 2 wherein said attachment means comprises a front bore hole extending into said front end of said receiver attachment member until it connects with said rear bore hole of said receiver attachment member, a bolt is insertable through said front bore hole so that said front end of said bolt can be threaded into a threaded bore hole in the rear end of a receiver member.

4. A recoil system for the receiver of a firearm as recited in claim 1 further comprising said rear end bore hole of said receiver attachment member having a front end having internal threads located adjacent said front end and wherein said means for rigidly securing said outer tubular member in said rear bore hole of said receiver attachment member comprises external threads adjacent said front end of said outer tubular member that mate with and are threaded into said internal threads located adjacent said front end of said rear end bore hole in said receiver attachment member.

5. A recoil system for the receiver of a firearm as recited in claim 1 wherein said gunstock sleeve member has locking means for rigidly securing said inner tubular member against axial travel.

6. A recoil system for the receiver of a firearm as recited in claim 5 wherein said locking means comprises a spring loaded adjustment lever assembly having a transversely movable head member that removably engages a recess on said outer surface of said inner tubular member.

7. A recoil system for the receiver of a firearm as recited in claim 6 further comprising a plurality of longitudinally spaced recesses on said outer surface of said inner tubular member that interact with adjustment means in said elongated gunstock sleeve member hereby said length of said butt stock assembly can be adjusted to fit different size shooters.

8. A recoil system for the receiver of a firearm as recited in claim 1 further comprising means for adjusting the length of said butt stock assembly to fit different size shooters.

9. A recoil system for the receiver of a firearm as recited in claim 1 wherein said extension spring means comprises an elongated extension spring having a front end and a rear end and being axially aligned within said inner tubular member; first means for rigidly securing said front end of said extension spring against axial travel within said inner tubular member; second means for rigidly securing said rear end of said extension spring so that recoil produced when a firearm is fired will produce recoil causing said outer tubular member to travel rearwardly with respect to said inner tubular member causing said extension spring to be stretched rearwardly and absorb said recoil.

10. A recoil system for the receiver of a firearm comprising:

an extension spring recoil assembly having a front end, a rear end, an elongated outer tubular member having an open rear end, and an elongated inner tubular member telescopically received in said open rear end of said outer tubular member; extension spring means connecting said inner tubular member to said outer tubular member for absorbing recoil produced when a firearm is fired;

a butt stock assembly having a longitudinally extending X-axis, a front end, a rear end and a front bore hole extends into said front end for reciprocally receiving the recoil of said outer tubular member of said extension spring recoil assembly when a firearm is fired; and means for connecting said front end of said extension spring recoil assembly to the rear end of a receiver member so that they travel axially as a single member.

11. A recoil system for the receiver of a firearm as recited in claim 10 wherein said butt stock assembly has locking means for rigidly securing said inner tubular member against axial travel.

12. A recoil system for the receiver of a firearm as recited in claim 11 wherein said locking means comprises a spring loaded adjustment lever assembly having a transversely movable head member that removably engages a recess on said outer surface of said inner tubular member.

13. A recoil system for the receiver of a firearm as recited in claim 12 further comprising a plurality of longitudinally spaced recesses on said outer surface of said inner tubular member that can selectively interact with said head member in said butt stock assembly whereby said butt stock assembly can be adjusted to fit different sized shooters.

14. A recoil system for the receiver of a firearm as recited in claim 10 further comprising means for adjusting the length of said butt stock assembly to fit different size shooters.

15. A recoil system for the receiver of a firearm as recited in claim 10 wherein said means for connecting said front end of said extension spring assembly to said rear end of said receiver comprises a pistol grip recoil assembly having a recoil base member and a pistol grip having a connector housing formed on its rear end adjacent its top end.

16. A recoil system for the receiver of a firearm as recited in claim 15 further comprising rotation means for rotating said butt stock assembly to a horizontal orientation.

* * * * *